US006220053B1

(12) United States Patent
Hass, Jr. et al.

(10) Patent No.: US 6,220,053 B1
(45) Date of Patent: Apr. 24, 2001

(54) CRYOGENIC INDUSTRIAL GAS LIQUEFACTION SYSTEM

(75) Inventors: Joseph William Hass, Jr., Amherst; Herbert Raymond Schaub, East Amherst; Michael Anthony Marino, Lancaster; Bayram Arman, Grand Island, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/479,986

(22) Filed: Jan. 10, 2000

(51) Int. Cl.[7] ..... F25J 1/00
(52) U.S. Cl. ..... 62/613; 62/619
(58) Field of Search ..... 62/613, 619

(56) References Cited

U.S. PATENT DOCUMENTS

| | | | |
|---|---|---|---|
| 3,677,019 | 7/1972 | Olszewski | 62/9 |
| 4,638,639 | 1/1987 | Marshall et al. | 62/9 |
| 4,778,497 | 10/1988 | Hanson et al. | 62/11 |
| 4,894,076 | 1/1990 | Dobracki et al. | 62/9 |
| 5,231,835 | 8/1993 | Beddome et al. | 62/9 |
| 5,799,505 | 9/1998 | Bonaquist et al. | 62/613 |
| 5,802,874 | 9/1998 | Voit | 62/650 |
| 5,836,173 | 11/1998 | Lynch et al. | 62/613 |

*Primary Examiner*—William Doerrler
*Assistant Examiner*—Malik N. Drake
(74) *Attorney, Agent, or Firm*—Stanley Ktorides

(57) ABSTRACT

A system for liquefying industrial gas wherein industrial gas is compressed to two levels using a first and a second compression system and then is processed in a heat exchanger having horizontally oriented sensible heat exchange passages and vertically oriented condensing heat exchange passages.

10 Claims, 1 Drawing Sheet

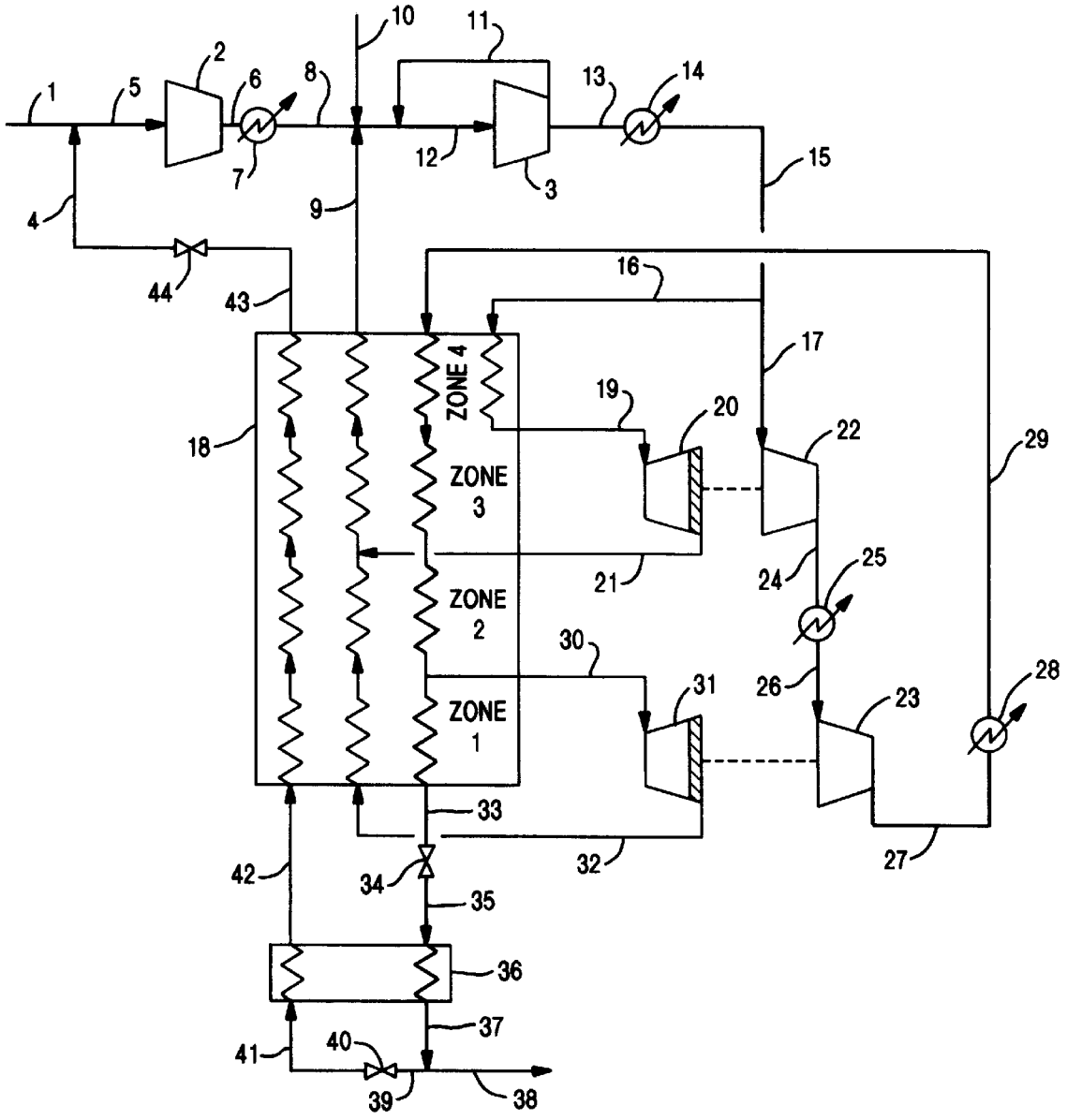
ZONE 4
ZONE 3
ZONE 2
ZONE 1

CRYOGENIC INDUSTRIAL GAS LIQUEFACTION SYSTEM

TECHNICAL FIELD

This invention relates generally to cryogenic heat exchange for the liquefaction of industrial gases.

BACKGROUND ART

Liquefaction of low boiling point gases, such as oxygen and nitrogen, is both capital and energy intensive. Typically practitioners have addressed the issue of improving liquefier performance by using multiple turbines and by using liquid expanders. Generally heat exchangers used with these systems are oriented in the vertical plane due to process hydraulic effects. This conventional practice leads to long piping runs of large bore warm end piping and also requires the utilization of significant footprint space for aftercooler heat exchangers and associated piping.

Accordingly it is an object of this invention to provide an industrial gas liquefaction system having an improved design and lower costs than conventional industrial gas liquefaction systems.

SUMMARY OF THE INVENTION

The above and other objects which will become apparent to those skilled in the art upon a reading of this disclosure, are attained by the present invention, one aspect of which is:

A method for liquefying an industrial gas comprising:

(A) compressing industrial gas to produce compressed industrial gas and further compressing a portion of the compressed industrial gas to produce a compressed first industrial gas portion and a further compressed second industrial gas portion;

(B) cooling the first industrial gas portion, turboexpanding the cooled first industrial gas portion, and warming the turboexpanded first industrial gas portion by horizontal countercurrent flow indirect heat exchange with the further compressed second industrial gas portion to cool the further compressed second industrial gas portion;

(C) dividing the cooled second industrial gas portion into a first part and a second part, turboexpanding said first part and warming the turboexpanded first part by indirect heat exchange with the second part of the cooled second industrial gas portion in vertical flow to liquefy said second part; and (D) recovering the liquefied second industrial gas part as product liquefied industrial gas.

Another aspect of the invention is:

Apparatus for liquefying an industrial gas comprising:

(A) a heat exchanger having horizontally oriented heat exchange passages and having vertically oriented heat exchange passages in flow communication with the horizontally oriented heat exchange passages;

(B) a first compression system, a second compression system, means for providing industrial gas to the first compression system and from the first compression system to a horizontally oriented passage of the heat exchanger, and means for providing industrial gas from the first compression system to the second compression system and from the second compression system to a horizontally oriented passage of the heat exchanger;

(C) a first turboexpander, a second turboexpander, means for passing industrial gas from a horizontally oriented passage of the heat exchanger to the first turboexpander and from the first turboexpander to another horizontally oriented passage of the heat exchanger and means for passing industrial gas from the heat exchanger to the second turboexpander and from the second turboexpander either to a vertically oriented passage or to a horizontally oriented passage of the heat exchanger; and (D) means for recovering liquefied industrial gas from a vertically oriented passage of the heat exchanger.

As used herein, the term "indirect heat exchange" means the bringing of two fluids into heat exchange relation without any physical contact or intermixing of the fluids with each other.

As used herein, the term "compressor" means a device which accepts gaseous fluid at one pressure and discharges it at a higher pressure.

As used herein, the terms "turboexpansion" and "turboexpander" mean respectively method and apparatus for the flow of high pressure gas through a turbine to reduce the pressure and the temperature of the gas, thereby generating refrigeration.

As used herein, the terms "subcooling" and "subcooler" mean respectively method and apparatus for cooling a liquid to be at a temperature lower than the saturation temperature of that liquid for the existing pressure.

As used herein the term "industrial gas" means a fluid comprised primarily of one or more of nitrogen, oxygen, natural gas or one or more other hydrocarbons.

BRIEF DESCRIPTION OF THE DRAWING

The sole FIGURE is a simplified schematic representation of one particularly preferred embodiment 10 of the cryogenic industrial gas liquefaction system of this invention.

DETAILED DESCRIPTION

The invention will be described in detail with reference to the Drawing. Referring now to the FIGURE, industrial gas 1, e.g. nitrogen, generally having a pressure up to about 20 pounds per square inch absolute (psia), such as from an air separation plant, is passed to a first compression system comprising feed compressor 2 and recycle compressor 3. In the embodiment illustrated in the FIGURE, industrial gas feed stream 1 is combined with recycle stream 4 to form combined stream 5 for passage to feed compressor 2.

Within feed compressor 2 the industrial gas feed is compressed to a pressure generally within the range of from 50 to 85 psia and resulting industrial gas stream 6 is cooled of the heat of compression in cooler 7. Resulting industrial gas stream 8 is passed to recycle compressor 3 of the first compression system. In the embodiment of the invention illustrated in the FIGURE a medium pressure return stream 9, an additional stream 10 from the air separation plant, and a recycle stream 11 from compressor 3 are all passed into industrial gas stream 8 to form industrial gas stream 12 for passage into recycle compressor 3.

Within recycle compressor 3 the industrial gas in stream 12 is compressed to a pressure generally within the range of from 190 to 380 psia to form compressed industrial gas stream 13. The heat of compression is removed from stream 13 by passage through cooler 14 and resulting compressed industrial gas stream 15 is divided into a first portion 16 and into a second portion 17.

Heat exchanger 18 is comprised of four zones identified as zones 1, 2, 3 and 4 in the FIGURE. The heat exchange passages in zone 1 are oriented vertically and the heat exchange passages in zone 2, 3 and 4 are oriented horizontally. Preferably in zone 1 all of the heat exchange passages are oriented vertically. However, the invention may also be practiced with horizontal parting sheets and cross flow orientation such that the return streams in zone 1 are oriented horizontally while the product stream is oriented vertically. It will be understood by those skilled in the art that small deviations from absolute vertical or absolute horizontal are allowable in the practice of this invention without unduly compromising the effectiveness of the invention.

First compressed industrial gas portion 16 is passed to an input of a horizontal heat exchange passage in zone 4 and is cooled by flow through that passage to form cooled first compressed industrial gas portion which is withdrawn from zone 4 of heat exchanger 18 in stream 19. The cooled first industrial gas portion in stream 19 is turboexpanded by passage through warm or first turboexpander 20 and resulting turboexpanded first industrial gas portion 21 is warmed by passage through zones 3 and 4 of heat exchanger 18, emerging therefrom as the aforementioned return stream 9.

Compressed second industrial gas portion 17 is further compressed by passage through a second compression system which in the embodiment illustrated in the FIGURE comprises warm booster compressor 22 and cold booster compressor 23. Stream 17 is compressed by passage through compressor 22 to a pressure generally within the range of 300 to 540 psia and resulting industrial gas stream 24 is cooled of the heat of compression by passage through cooler 25. Resulting stream 26 is compressed by passage through compressor 23 to a pressure generally within the range of from 450 to 760 psia emerging therefrom as further compressed second industrial gas portion in stream 27. Further compressed second industrial gas portion 27 is cooled of the heat of compression by passage through cooler 28 and resulting further compressed second industrial gas portion is passed in stream 29 into a horizontal heat exchange passage in zone 4 of heat exchanger 18.

The further compressed second industrial gas portion is cooled by passage through zones 4, 3 and 2 of heat exchanger 18 by indirect heat exchange with countercurrently flowing warming streams such as stream 21, as was previously described, to form cooled second industrial gas portion, a first part of which is withdrawn from heat exchanger 18 in stream 30 and passed to cold or second turboexpander 31. Stream 30 is turboexpanded by passage through turboexpander 31 and resulting turboexpanded stream 32 is passed into a preferably vertically oriented heat exchange passage in zone 1 of heat exchanger 18.

The remaining or second part of the cooled second industrial gas portion is passed downwardly through zone 1 of heat exchanger 18 preferably countercurrently to upwardly flowing streams such as aforementioned stream 32 and is liquefied by indirect heat exchange therewith to form liquefied industrial gas second part in stream 33. As illustrated in the FIGURE, stream 32, after the heat exchange with the cooled industrial gas second part, passes horizontally through zone 2 of heat exchanger 18 and then combines with stream 21 for further passage through zones 3 and 4 of heat exchanger 18 before emerging as previously described stream 9.

Stream 33 may be recovered as product liquefied industrial gas. The FIGURE illustrates a particularly preferred embodiment of the invention wherein stream 33 is subcooled prior to recovery. In accordance with this particularly preferred embodiment, stream 33 which may be a liquid or pseudo-liquid depending on its composition and pressure, is throttled through valve 34 to a pressure generally within the range of from 80 to 120 psia and resulting stream 35 is subcooled by passage through subcooler 36, from which it is withdrawn as subcooled stream 37, some or all of which is recovered as product liquefied industrial gas in stream 38. In the embodiment illustrated in the FIGURE, not all of stream 37 is recovered directly but rather a stream 39 from stream 37 is throttled through valve 40 to a pressure typically within the range of from 16 to 19 psia and passed as stream 41 through subcooler 36 wherein it is warmed by indirect heat exchange to effect the subcooling of stream 35. Resulting stream 42 is passed from subcooler 36 to heat exchanger 18 and is warmed by passage through heat exchanger 18 preferably countercurrently by indirect heat exchange with the aforesaid cooling or condensing streams. Stream 42 flows upwardly in zone 1 of heat exchanger 18 and horizontally through zones 2, 3 and 4 of heat exchanger 18, emerging therefrom as warm stream 43, which is passed through valve 44 to form recycle stream 4 as was previously described.

With the use of horizontal countercurrent indirect heat exchange in the sensible heat exchange zones and vertical countercurrent heat exchange in the condensing zone of the liquefier heat exchanger, a more efficient industrial gas liquefaction is achieved. Shorter piping runs to unit operations outside the cold box package can be used, and equipment skid design is facilitated. Sensible heat exchange is maximized while fluid distribution especially in the condensing zone is facilitated.

Although the invention has been described in detail with reference to a particularly preferred embodiment, those skilled in the art will recognize that there are other embodiments of the invention within the spirit and the scope of the claims. For example, a parallel turbine arrangement could also be employed to carry out the invention.

What is claimed is:

1. A method for liquefying an industrial gas comprising:

(A) compressing industrial gas to produce compressed industrial gas and further compressing a portion of the compressed industrial gas to produce a compressed first industrial gas portion and a further compressed second industrial gas portion;

(B) cooling the first industrial gas portion, turboexpanding the cooled first industrial gas portion, and warming the turboexpanded first industrial gas portion by horizontal countercurrent flow indirect heat exchange with the further compressed second industrial gas portion to cool the further compressed second industrial gas portion;

(C) dividing the cooled second industrial gas portion into a first part and a second part, turboexpanding said first part and warming the turboexpanded first part by indirect heat exchange with the second part of the cooled second industrial gas portion in vertical flow to liquefy said second part; and (D) recovering the liquefied second industrial gas part as product liquefied industrial gas.

2. The method of claim 1 wherein the liquefied second part is subcooled prior to recovery as product liquefied industrial gas.

3. The method of claim 2 wherein a partial flow of the subcooled liquefied second part is reduced in pressure and then warmed by indirect heat exchange to carry out the subcooling of the liquefied second part.

4. The method of claim 3 wherein the resulting warmed partial flow is further warmed by vertical countercurrent indirect heat exchange with the cooled second industrial gas part to assist in liquefying said second part.

5. The method of claim 4 wherein the resulting further warmed partial flow is still further warmed by horizontal countercurrent indirect heat exchange with the further compressed second industrial gas portion to assist in cooling said second industrial gas portion.

6. Apparatus for liquefying an industrial gas comprising:

(A) a heat exchanger having horizontally oriented heat exchange passages and having vertically oriented heat exchange passages in flow communication with the horizontally oriented heat exchange passages;

(B) a first compression system, a second compression system, means for providing industrial gas to the first compression system and from the first compression system to a horizontally oriented passage of the heat exchanger, and means for providing industrial gas from the first compression system to the second compression system and from the second compression system to a horizontally oriented passage of the heat exchanger;

(C) a first turboexpander, a second turboexpander, means for passing industrial gas from a horizontally oriented passage of the heat exchanger to the first turboexpander and from the first turboexpander to another horizontally oriented passage of the heat exchanger and means for passing industrial gas from the heat exchanger to the second turboexpander and from the second turboexpander to either a vertically oriented passage or to a horizontally oriented passage of the heat exchanger; and (D) means for recovering liquefied industrial gas from a vertically oriented passage of the heat exchanger.

7. The apparatus of claim 6 further comprising a subcooler wherein the means for recovering liquefied industrial gas from a vertically oriented passage of the heat exchanger includes the subcooler.

8. The apparatus of claim 7 further comprising a throttle valve, means for passing fluid from the subcooler to the throttle valve, and means for passing fluid from the throttle valve back to the subcooler.

9. The apparatus of claim 8 further comprising means for passing fluid from the subcooler to the heat exchanger.

10. The apparatus of claim 6 further comprising means for passing fluid from the heat exchanger to the first compression system.

* * * * *

UNITED STATES PATENT AND TRADEMARK OFFICE

CERTIFICATE OF CORRECTION

PATENT NO. : 6,220,053 B1
DATED : April 24, 2001
INVENTOR(S) : Haas, Jr. et al.

It is certified that error appears in the above-identified patent and that said Letters Patent is hereby corrected as shown below:

Title page,
Item [12], delete "Hass, Jr. et al." and insert therefor -- Haas, Jr. et al. --
Item [75], delete "Joseph William Hass, Jr." and insert therefor -- Joseph William Haas, Jr. --

Signed and Sealed this

Sixth Day of November, 2001

*Attest:*

Nicholas P. Godici

*Attesting Officer*

NICHOLAS P. GODICI
*Acting Director of the United States Patent and Trademark Office*